US010533572B2

(12) United States Patent
Gallina et al.

(10) Patent No.: US 10,533,572 B2
(45) Date of Patent: Jan. 14, 2020

(54) BLADE UNIT FOR INDUSTRIAL FANS

(71) Applicant: Cofimco S.r.l., Pombia (IT)

(72) Inventors: Carlo Gallina, Pombia (IT); Nicola Romano, Pombia (IT)

(73) Assignee: Cofimco S.R.L., Pombia (No) (IT)

( * ) Notice: Subject to any disclaimer, the term of this patent is extended or adjusted under 35 U.S.C. 154(b) by 192 days.

(21) Appl. No.: 15/522,665

(22) PCT Filed: Oct. 27, 2015

(86) PCT No.: PCT/IB2015/058266
§ 371 (c)(1),
(2) Date: Apr. 27, 2017

(87) PCT Pub. No.: WO2016/075575
PCT Pub. Date: May 19, 2016

(65) Prior Publication Data

US 2017/0314569 A1 Nov. 2, 2017

(30) Foreign Application Priority Data

Nov. 11, 2014 (IT) ..... TO2014A0938

(51) Int. Cl.
*F04D 29/34* (2006.01)
*F04D 25/08* (2006.01)
*F04D 29/38* (2006.01)

(52) U.S. Cl.
CPC ..... *F04D 29/34* (2013.01); *F04D 25/08* (2013.01); *F04D 29/388* (2013.01)

(58) Field of Classification Search
CPC ..... F04D 29/34; F04D 25/088; F04D 25/08; F04D 29/388
See application file for complete search history.

(56) References Cited

U.S. PATENT DOCUMENTS 4,884,948 A 12/1989 Sikorski
2008/0193294 A1* 8/2008 Grant ..... F04D 25/088 416/204 R

FOREIGN PATENT DOCUMENTS

| | | | | |
|---|---|---|---|---|
| CN | 202789561 U | 3/2013 | | |
| EP | 2025947 A1 | 2/2009 | | |
| EP | 2071193 A1 * | 6/2009 | ..... | F04D 29/023 |
| EP | 2071193 A1 | 6/2009 | | |
| GB | 2498077 A | 7/2013 | | |

OTHER PUBLICATIONS

International Search Report and Written Opinion dated Jan. 22, 2016 for Application No. PCT/IB2015/058266.
Chinese Office Action dated Aug. 2, 2018 for Application No. 201580061424.1.

* cited by examiner

*Primary Examiner* — Xiao En Mo
(74) *Attorney, Agent, or Firm* — Cook Alex Ltd.; R. Blake Johnston

(57) ABSTRACT

Described herein is a blade unit for industrial fans, which comprises: a blade; and a tubular bar, fixed on which is said blade and which has a root portion configured for being engaged by means for connecting said bar to the rotor of a fan. The unit is characterized in that it comprises a further bar mounted within said first tubular bar so as to present a first portion axially constrained to said first bar, and a second portion that is, instead, able to slide with respect to said first bar, in a condition of sliding friction, following upon a deformation due to bending of said first bar.

18 Claims, 3 Drawing Sheets

BLADE UNIT FOR INDUSTRIAL FANS

The present invention relates to a blade unit for industrial fans, which comprises:

a blade; and a tubular bar, fixed on which is said blade and which has a root portion configured for being engaged by means for connecting said bar to the rotor of a fan.

In fans for industrial use, above all in those of large diameter, the impeller of which may present diameters of up to 20 m, the blades are subject to high cyclic and impulsive loads that subject them to considerable fatigue stresses, sensibly reducing the service life thereof.

The object of the present invention is hence to provide a blade unit that will present a higher fatigue strength as compared to units of a conventional type.

The object referred to above is achieved via a blade unit having the characteristics recalled in one or more of the ensuing claims.

The claims form an integral part of the technical teaching provided herein in relation to the invention.

The invention will now be described purely by way of non-limiting example with reference to the annexed drawings, in which.

In the ensuing description, various specific details are illustrated aimed at providing an in-depth understanding of the embodiments. The embodiments may be obtained without one or more of the specific details, or with other methods, components, or materials, etc. In other cases, known structures, materials, or operations are not illustrated or described in detail so that various aspects of the embodiment will not be obscured.

The references used herein are provided merely for convenience and hence do not define the sphere of protection or the scope of the embodiments.

With reference to the figures, the blade unit described herein, designated by the reference number 10, comprises a blade or vane 2 of appropriate profile, and a bar 4 fixed thereto, configured for being connected to the hub or rotor of a fan for industrial use.

Figure 4:
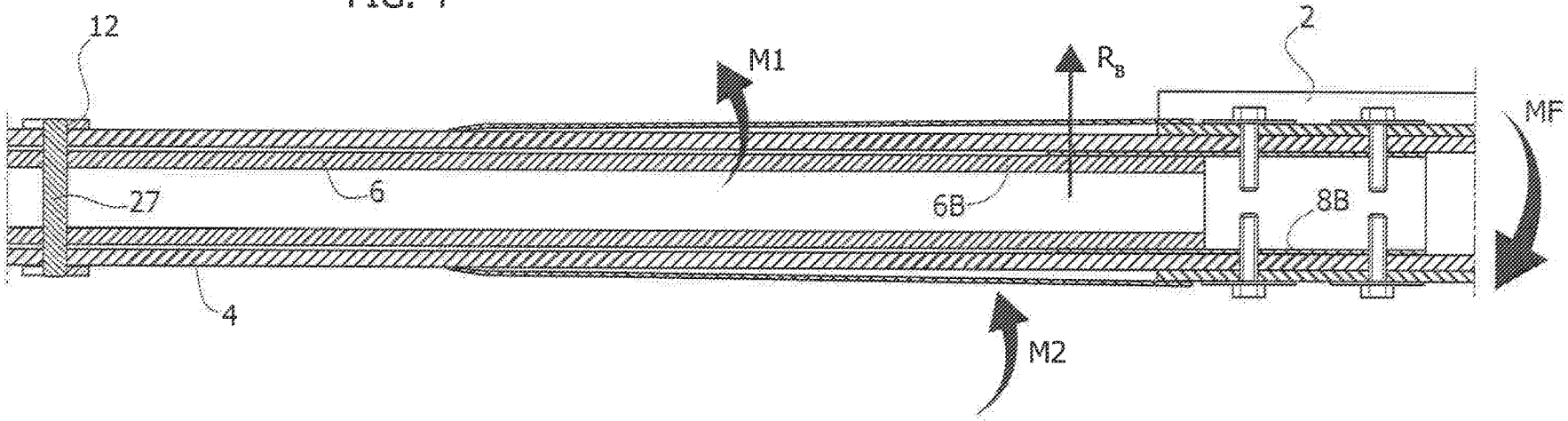
FIG. 4 represents the blade unit of FIG. 2 in front view.

The blade 2 has a longitudinal internal cavity, housed within which is the bar 4, which is fixed to the blade 2 via screws as in the example of FIG. 4 or any other fixing system (such as gluing, riveting, etc.) and projects from the blade with a root portion 4 *a* configured for being connected to the hub or rotor of the fan.

Figure 3:
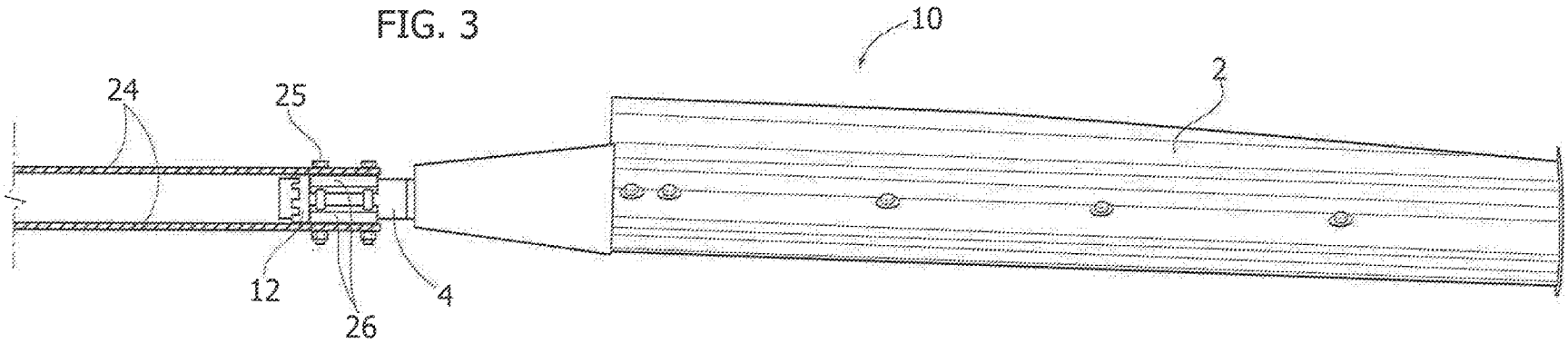
FIG. 3 is a partially sectioned front view of the impeller of FIG. 1.

In particular, the root portion of the bar 4 is to be connected to the hub or rotor of the fan via a system of adapters 26 (FIG. 3) and bolts that block the blade to the hub or rotor by friction. A collar 12 aids positioning of the blade properly with respect to the hub or rotor.

Figure 1:
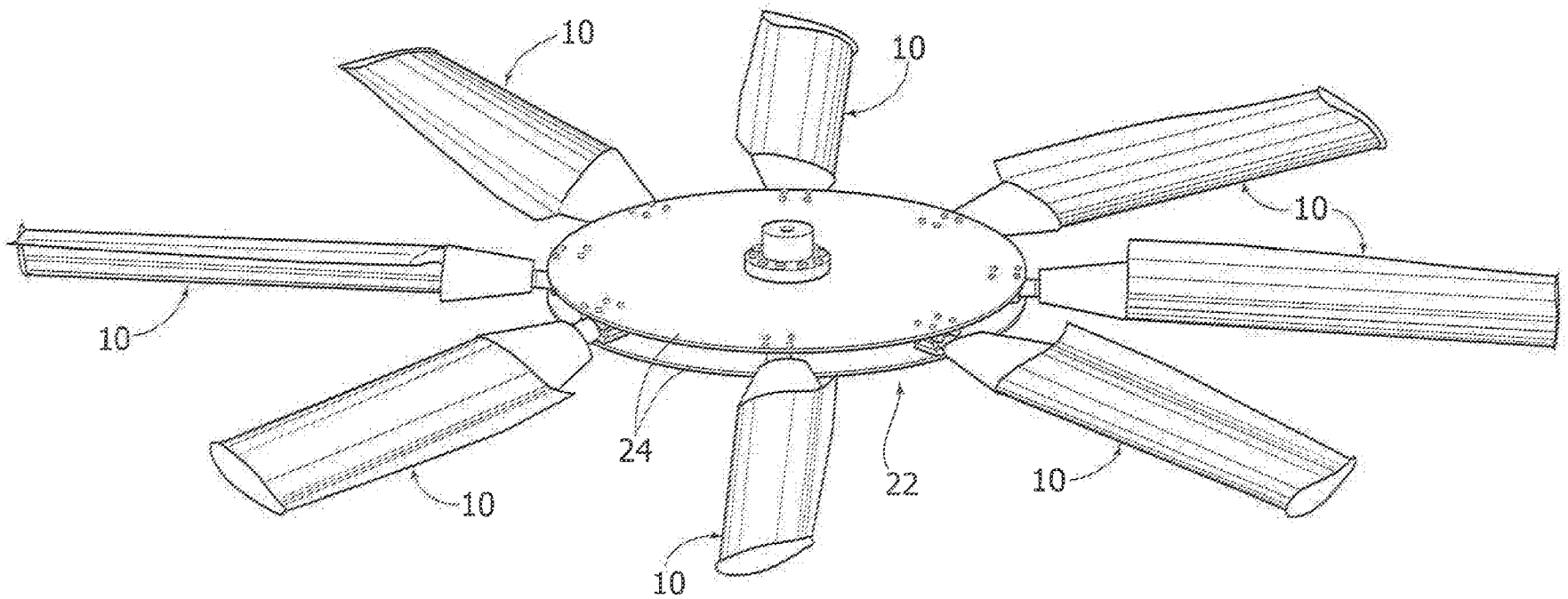
FIG. 1 is a perspective view of an impeller of a fan for industrial use equipped with a blade unit of the type described herein.
Figure 2:
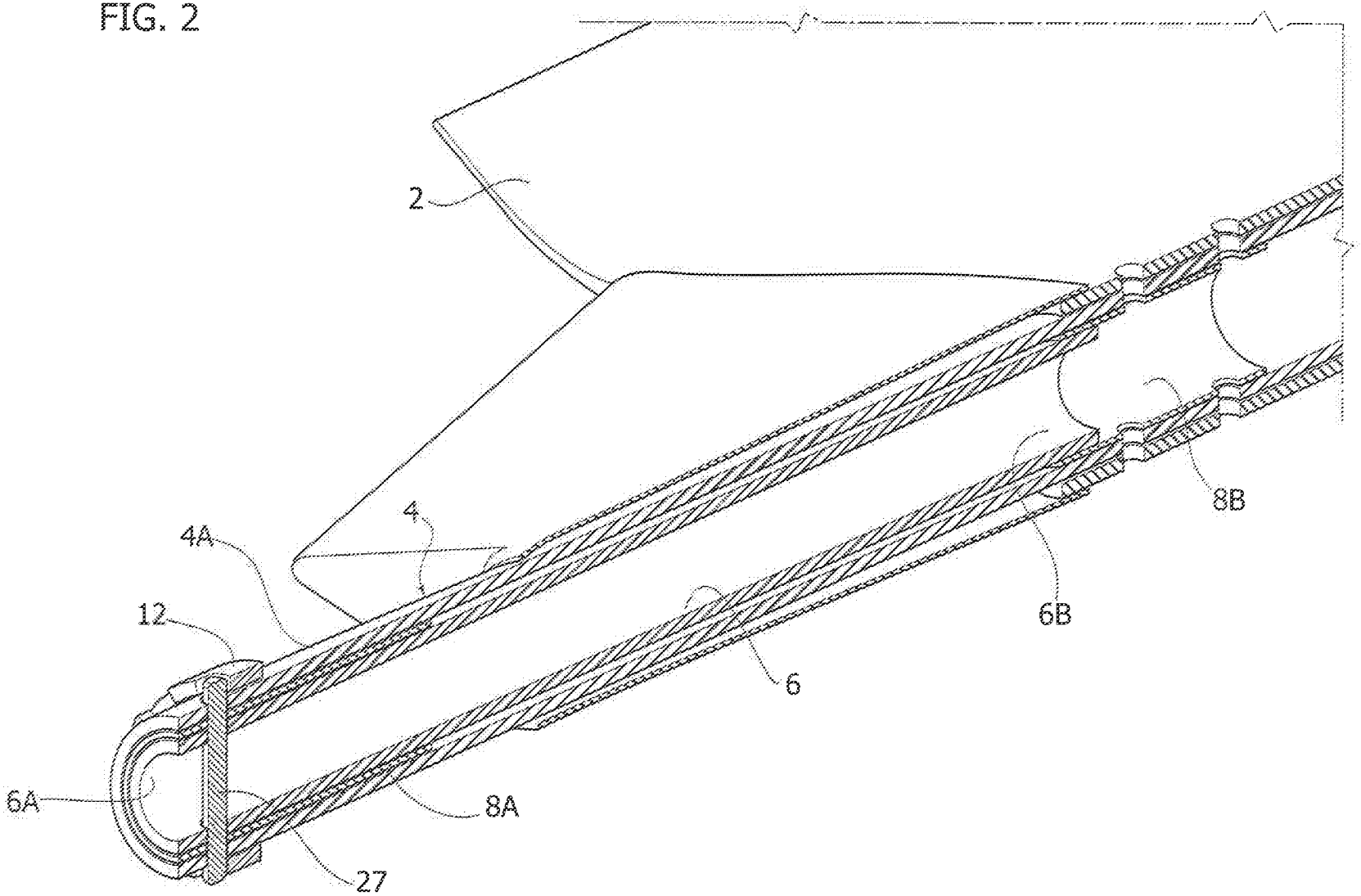
FIG. 2 is a partial perspective view of an embodiment of the blade unit described herein, where the unit is sectioned along a plane parallel to the longitudinal axis of the blade.

In the example illustrated in FIG. 1, the hub or rotor of the fan, designated by the reference number 22, is, in particular, constituted by two coaxial disks 24, set at an appropriate distance from one another for enabling the various collars that engage the bars 4 of the blades of the fan to be housed in the space defined between the two disks. The hub may in any case have different configurations and not necessarily be constituted by two disks.

The blade illustrated in the figures constitutes an example of blade for use on an axial fan. The blade unit described herein can in any case be produced also for other types of fans, for example radial ones, and, in general, the blade 2 can present any configuration according to the specific application for which it is designed.

The blade unit described herein is characterized in that it comprises a further tubular bar 6 mounted within the bar 4, preferably at the root portion 4 *a*. The end or first portion 6 *a* of the bar 6 closer to the end of the root portion is axially constrained to the bar 4 via appropriate connection means, whereas its opposite end or second portion 6 *b*, which faces the tip of the blade 2, is not fixed thereto, but rather is able to slide with respect to the bar 4 when this undergoes deformation due to bending. Preferably, the end or second portion 6 *b* is housed within the bar 4 according to a configuration whereby it is able to slide in a condition of sliding friction with respect to the bar 4.

The further bar 6 mainly acts like a member for damping the high oscillations of the blade 2 deriving from the high cyclic and above all impulsive loads, such as gusts of wind, that are frequently induced in blades of large fans and result in fatigue and reduce the service life of the blades and of the connection systems. As will be seen in fact in detail hereinafter, the bar 6 not only opposes any external action tending to bend the bar 4, but, as a result of the forces of friction that are set up between the bar 4 and its end or second portion 6 *b*, also exerts an action of countering the movement itself of the bar and of dissipating the kinetic energy of oscillation of the blade, whether this occurs in the direction of bending of the bar or in the direction of return to its rectilinear condition.

In various preferred embodiments, as in the one illustrated, the blade unit in question comprises a first bushing 8*a* and a second bushing 8*b*, which are set within the bar 4, have a shape and dimensions appropriate for coupling therewith without play, and are fixed to the bar 4 itself. This fixing may be obtained via screws or any other system (such as gluing, riveting, use of a pin 27, etc.).

The two bushings 8 *a*, 8 *b* are engaged, respectively, by the opposite ends or first and second portions 6 *a*, 6 *b* of the bar 6 and are set at an appropriate distance apart so that the bar 6 comes to face directly, for a given portion thereof, the inner surface of the bar 4, but not in contact therewith. This configuration enables concentration of the forces of friction, due to sliding of the bar 6 with respect to the bar 4, in the region of the bushing 8 *b* and, via the latter, at the end or second portion 6 *b* of the bar 6, where the action of countering the movement of the blade exerted by these forces and the consequent energy dissipation are more effective.

The end or second portion 6 *b* has a shape and dimensions such as to engage the bushing 8 *b* in an appropriate condition of play. The end or first portion 6 *a* is, instead, fixed to the bushing 8 *a* via screws or any other system so as to be rigidly constrained thereto. For the end or second portion 6 *b*, no connection means are instead provided for fixing it directly to the bushing 8 *b*. In line with what has been said previously, for this end it is in fact envisaged that it can slide in a condition of sliding friction with respect to the bushing 8 *b* when the bar 4 is subject to a deformation due to bending, for the aforementioned purpose of damping the cyclic and, above all, impulsive oscillations of the blade. In this connection, the present applicant has identified that excellent results in this sense are obtained when the coupling between the end or second portion 6 *b* and the bushing 8 *b* is in a condition of play that range from 0 mm to 2 mm.

In various preferred embodiments, as in the one illustrated, the bushing 8*a* and the end 6*a* of the bar 6 are axially constrained to the bar 4 via the pin 27. In the same way, in this example, the bushing 8*b* is axially constrained to the bar 4 via two pairs of screws that at the same time fix the blade 2 to the bar 4.

With reference once again to the mechanical behaviour of the blade unit described herein, FIG. 4 illustrates schematically the action of the bar 6 when a bending moment Mf of a cyclic or impulsive type acts on the blade 2.

As may be seen in the above figure, the moment Mf bends the bar 4, which in turn causes bending of the bar 6. The bar 6 exerts above all an action of countering displacement of the bar 4 from its, undeformed, rectilinear condition via the force of reaction RB acting on the inner surface of the bushing 8B. This force is transmitted to the bar 4 via the outer surface of the bushing 8*b* resulting in a moment of reaction represented in FIG. 4 by the moment M1 having a sign opposite to that of the moment Mf.

Bending of the two bars 4 and 6 then brings about a mutual sliding thereof so that the end or second portion 6 *b* of the bar 6 comes to slide with respect to the bushing 8 *b*, in a condition of sliding friction. The forces of friction generated between the two bars as a result of this sliding oppose the aforesaid movement, generating a further moment M2 opposite to the moment Mf.

The moment Mf may have a cyclic or impulsive nature. If it is cyclic, the action of the bar 6 results in a sensible reduction of the oscillations of the blade 2. If it is impulsive, it exerts its action for a limited time and, once it has ceased, the blade 2 tends to return elastically into its condition where it is more or less deformed by the loads acting on the blade during its normal operation. The moment M2 generated by the interaction of the bar 6 with the bushing 8*b* is always in the opposite direction with respect to the direction of displacement of the blade 2 and consequently exerts a damping action in regard to these oscillating motions.

In various embodiments, as in the one illustrated, the bars 4 and 6 are made of composite material, in particular fibreglass, by means of a pultrusion process. Preferably, the resin used is vinyl ester or epoxy resin and the reinforcement is constituted by rovings and multidirectional glass fabrics. In cases of particularly high bending loads, the reinforcement may be further strengthened with the addition of carbon rovings. The carbon rovings have the same length as the respective bars 4 and 6. The best results are obtained with a weight percentage of carbon of between 3 wt % and 3.5 wt % with respect to the weight of each bar. This, however, does not represent a limit to the system that can be obtained using bars of different materials, preferably composites, obtained with different technologies/processes.

This enables an overall structure of the blade unit to be obtained that is strong and is able to manage effectively the cyclic and impulsive loads as compared to blade units of a conventional type, which usually have generally very stiff connections to the hub that are made of steel or fibreglass. On the one hand, the increased flexibility enables a sensible reduction of the loads that are transmitted by the blade unit to the hub of the fan and consequently to the means for driving the fan and to the supporting structure. Furthermore, it means that the impeller of the fan presents an overall structure having a natural frequency much further from the frequencies of the vibrations that may be generated during normal operation of the fan, thus reducing considerably the risks linked to possible phenomena of resonance.

The present applicant has found that the combination of the damping system determined by the bar 6, with a bar 4 obtained in the way described above, enables a blade unit to be obtained that presents a mechanical behaviour decidedly improved as compared to conventional units.

The reduction of the blade oscillations deriving from cyclic and impulsive loads, together with the blade frequency obtained, results in a reduction of the stresses transmitted by the fans to the supporting structure and hence of its vibrations. In this connection, appearing below are tables that compare the vibrations measured on the supporting structure of a fan provided with conventional blade units and those of a fan equipped with blade units of the type described above, obviously given the same dimensions and conditions of operation. It is to be noted that the conventional blade units in question were made of fibreglass obtained by moulding.

Comparison 1

| Type of fan | Direction | | |
|---|---|---|---|
| Diameter of impeller: 9.144 m<br>Number of blades: 8 | X<br>mm/s RMS | Y<br>mm/s RMS | Z<br>Mm/s RMS |
| Conventional | 2.5 | 2.3 | 5.7 |
| With new blade units | 2.0 | 1.8 | 2.1 |

Comparison 2

| Type of fan | Direction | | |
|---|---|---|---|
| Diameter of impeller: 9.75 m<br>Number of blades: 6 | X<br>mm/s RMS | Y<br>mm/s RMS | Z<br>Mm/s RMS |
| Conventional | 3.1 | 4.2 | 7.8 |
| With new blade units | 2.8 | 2.1 | 2.7 |

In the tables appearing above, the directions X and Y are horizontal directions, in the plane of the impeller, whereas the direction Z is the vertical direction, orthogonal to the plane of the impeller. As emerges from the above tables, in fans equipped with blade units of the type described herein there has been found a general reduction, in all directions, of the intensity of vibrations as compared to fans with traditional blades, with a maximum reduction that exceeds 50%, in the direction Z.

Of course, without prejudice to the principle of the invention, the details of construction and the embodiments may vary, even significantly, with respect to what has been illustrated herein purely by way of non-limiting example, without thereby departing from the scope of the invention, as defined by the annexed claims. For instance, the bushings 8*a* and 8*b* may even not be envisaged, and the bar 6 may in this case envisage portions that directly engage the bar 4 in the modalities described above. Furthermore, in alternative embodiments, the bar 6 can be constrained to the bar 4 at its internal portions distinct from its end portions.

The invention claimed is:

1. A unit for industrial fans, comprising:

a blade;

a first tubular bar, fixed on which is said blade and which has a root portion configured for being engaged by means for connecting said first tubular bar to a rotor of a fan;

a further bar mounted within said first tubular bar so as to present a first portion constrained axially to said first tubular bar and a second portion that is instead able to slide with respect to said first tubular bar, in a condition of sliding friction, following upon a deformation due to bending of said first tubular bar.

2. The unit according to claim 1, wherein said further bar is set at said root portion of said first tubular bar.

3. The unit according to claim 1, wherein said first portion and said second portion of said further bar are set at a distance from one another, and define a first end and a second end of said bar, respectively.

4. The unit according to claim 3, wherein the second portion is configured to axially slide with respect to said first tubular bar and an intermediate portion of said further bar set between said first and second portions directly faces, but is not in contact with, an inner surface of said first tubular bar, where an annular space is defined between the intermediate portion of said further bar and the inner surface of the first tubular bar.

5. The unit according to claim 1, wherein said further bar is mounted within said first tubular bar according to an orientation whereby said second portion is closer to said blade than is said first portion.

6. The unit according to claim 1, comprising a first bushing and a second bushing, which are fixed inside said first tubular bar and within which said first and second portions of said further bar are, respectively, received, wherein said first portion is fixed via connection means to said first bushing, whereas said second portion engages said second bushing and is configured to axially slide with respect to said first tubular bar.

7. The unit according to claim 1, wherein said first tubular bar and/or said further bar is made of composite material by means of a pultrusion process.

8. The unit according to claim 7, wherein said composite material is constituted by fibreglass reinforced with roving and/or carbon fibre.

9. The unit according to claim 6, wherein said second portion engages said second bushing in a condition of play that ranges from 0 mm to 2 mm.

10. A unit for industrial fans, comprising:

a blade;

a first tubular bar, upon which is mounted said blade and which has a root portion configured to connect said first tubular bar to a rotor of a fan;

a further bar mounted within said first tubular bar, said further bar including a first portion mounted to said first tubular bar so as to be constrained axially and a second portion that is configured to slide with respect to said first tubular bar, in a condition of sliding friction, as said first tubular bar is deformed due to bending.

11. The unit according to claim 10, wherein said further bar is set at said root portion of said first tubular bar.

12. The unit according to claim 10, wherein said first portion and said second portion of said further bar are set at a distance from one another, and preferably define a first end and a second end of said bar, respectively.

13. The unit according to claim 12, wherein the second portion is configured to axially slide with respect to said first tubular bar and an intermediate portion of said further bar set between said first and second portions directly faces, but is not in contact with, an inner surface of said first tubular bar, where an annular space is defined between the intermediate portion of said further bar and the inner surface of the first tubular bar.

14. The unit according to claim 10, wherein said further bar is mounted within said first tubular bar according to an orientation whereby said second portion is closer to said blade than is said first portion.

15. The unit according to claim 10, comprising a first bushing and a second bushing, which are fixed inside said first tubular bar and within which said first and second portions of said further bar are received, respectively, wherein said first portion is fixed to said first bushing, whereas said second portion engages said second bushing and is configured to axially slide with respect to said first tubular bar.

16. The unit according to claim 10, wherein said first tubular bar and/or said further bar is made of composite material by means of a pultrusion process.

17. The unit according to claim 16, wherein said composite material is constituted by fibreglass reinforced with roving and/or carbon fibre.

18. The unit according to claim 15, wherein said second portion engages said second bushing in a condition of play that ranges from 0 mm to 2 mm.

* * * * *